US006830102B2

(12) United States Patent
Kirk et al.

(10) Patent No.: US 6,830,102 B2
(45) Date of Patent: Dec. 14, 2004

(54) CENTRALISER

(75) Inventors: Ian Alastair Kirk, Aberdeen (GB); William Barron, Aberdeen (GB); Alistair Bertram Clark, Aberdeen (GB)

(73) Assignee: Downhole Products PLC, Aberdeen (GB)

( * ) Notice: Subject to any disclaimer, the term of this patent is extended or adjusted under 35 U.S.C. 154(b) by 0 days.

(21) Appl. No.: 10/182,099

(22) PCT Filed: Jan. 18, 2001

(86) PCT No.: PCT/GB01/00174

§ 371 (c)(1),
(2), (4) Date: Jul. 22, 2002

(87) PCT Pub. No.: WO01/53652

PCT Pub. Date: Jul. 26, 2001

(65) Prior Publication Data

US 2003/0010540 A1 Jan. 16, 2003

(30) Foreign Application Priority Data

Jan. 22, 2000 (GB) ..... 0001435

(51) Int. Cl.[7] ..... E21B 17/10
(52) U.S. Cl. ..... 166/241.6; 166/241.2

(58) Field of Search ..... 166/241.1, 241.2, 166/241.3, 241.4, 241.6, 241.7

(56) References Cited

U.S. PATENT DOCUMENTS

| | | | | |
|---|---|---|---|---|
| 4,182,537 | A | 1/1980 | Oster | |
| 5,803,193 | A | 9/1998 | Moore | |
| 5,810,100 | A | 9/1998 | Samford | |
| 6,378,633 | B1 * | 4/2002 | Moore et al. | 175/325.5 |
| 6,513,223 | B1 * | 2/2003 | Angman et al. | 29/447 |

FOREIGN PATENT DOCUMENTS

| | | | |
|---|---|---|---|
| GB | 2290331 | A | 12/1995 |
| GB | 2339584 | A | 2/2000 |
| WO | WO 95 10685 | A | 4/1995 |
| WO | WO 98 37302 | A | 8/1998 |
| WO | WO 99 25949 | A | 5/1999 |

* cited by examiner

*Primary Examiner*—David Bagnell
*Assistant Examiner*—Jennifer Dougherty
(74) *Attorney, Agent, or Firm*—Drinker Biddle & Reath LLP

(57) ABSTRACT

A centraliser primarily for use when casing an oil or gas well, the centraliser having low frictions coatings or sliders on the outer surface thereof.

17 Claims, 6 Drawing Sheets

CENTRALISER

This Application is the U.S. National Phase Application of PCT International Application No. PCT/GB01/00174 filed Jan. 18, 2001.

This invention relates to a centraliser and relates more particularly but not exclusively to a casing centraliser for facilitating the cementing of casing in a well.

DESCRIPTION OF THE RELATED ART

When a well has been drilled for the eventual production of hydrocarbons, one of the procedures commonly employed in readying the well for production comprises placing a hollow tubular casing in the well, and filling the space between the exterior of the casing and the well bore with cement, principally as a sealant and also as a mechanical support. It is desirable that the casing is centralised in the well bore when cemented, and proposals have been made for providing the casing (prior to cementing) with externally mounted centralisers to hold the casing away from the well bore and towards the centre of the bore.

BRIEF SUMMARY OF THE INVENTION

According to a first aspect of the present invention there is provided a centraliser having a body with a bore therethrough for receiving a tubular to be centralised, the body having one or more low friction sliders on the outer surface thereof.

The invention also provides a centraliser having a body with a bore therethrough for receiving a tubular to be centralised, the body having a low friction coating.

The centraliser typically has blades on its outer surface to bear against the wall of a borehole and the slider may comprise the whole or part of a blade. The blades are typically arranged in a peripheral array circumferentially distributed around said body to define a flow path between each circumferentially adjacent pair of blades. Each flow path typically provides a fluid flow path between longitudinally opposite ends of said centraliser, and each blade typically has a radially outer edge providing a well bore-contacting surface. In a simple embodiment of the centraliser the radially outer edge of at least one blade has a low friction coating, strip or block applied thereto by any convenient means.

The inner surface can also have sliders, coatings or strips applied thereto in order to reduce frictional resistance to rotation of the centraliser on the tubular.

The centraliser is preferably a casing centraliser.

The invention also provides a centraliser assembly comprising a centraliser and tubular casing extending longitudinally through the bore of the body. The bore is typically a clearance fit around the tubular casing to be centralised by the centraliser.

The centraliser is preferably free of any means tightly gripping a casing when said centraliser is installed on it, so that the centraliser and casing can rotate relative to one another.

The centraliser body can be made wholly of partially of metals such as Zinc, Steel or Aluminium, or can be of composite materials such as fibreglass, or any other suitable material. We have successfully used the "ZA" range of zinc alloys supplied by Brock Alloys (GB), and have cast the centraliser body from these materials.

The sliders preferably engage in pre-formed slots or apertures in the body, typically on the outer surface, so that they protrude slightly from the aperture or slot to extend slightly proud of the outermost surface of the centraliser body. The blades are especially good mounts for the sliders, as hollows or slots etc can be readily machined or cast into the material of the or each blade.

The sliders can be of any desired shape but they typically provide a bearing surface with a lower friction coefficient than the body of the centraliser or (in some embodiments) the blades. This enhances the friction coefficient of the centraliser and helps it to slide past obstructions more easily.

The sliders are typically in the form of buttons, patches or strips that are either attached to or inserted into the outer surface of the body, so that they will contact the wellbore or other surface in use before the rest of the body of the centraliser. However the sliders can in certain embodiments comprise the blades with a simple coating of low friction material thereon.

The sliders can be formed from low friction materials to reduce the force needed to slide the centraliser past or along a surface or protrusion, and preferred low friction materials include engineering plastics such as polymeric ethylene compounds, nylon compounds, or any low friction plastics material. Particularly suitable compounds include PTFE, polyetheretherketone, carbon reinforced polyetheretherketone, polyphthalamide, polyvinylidene fluoride, polyphenylylene sulphide, polyetherimide, polyethylene, polysulphone, polyethersulphone, polybutyleneterephthalate, polyetherketoneketone, polyamides, phenolic resins or compounds, thermosetting plastics, thermoplastic elastomers, thermoplastic compounds or thermoplastic polyester resins, PETP, Ketron Peek, Torlon, Nylatron, Ultrawear, and Fluorosint, and their chemical equivalents and related compounds. Preferred coatings include metal/plastic composites such as nickel/phosphorous embedded with PTFE or another low-friction substance.

The blades are preferably equidistantly distributed around the body from one another. They preferably each extend circumferentially at least part-way around the body between longitudinally opposite ends to provide a circumferential distribution of each of the well bore-contacting surfaces. Each blade preferably has a radially inner root integral with the body, and each blade's root is preferably circumferentially wider than its radially outer edge.

The blades are preferably circumferentially wider at one end (typically the lower end) of the centraliser than at the other (typically lower) end in use. The centraliser preferably has four to six blades.

Longitudinally opposite ends of the blades and/or the body may be chamfered or tapered so as to facilitate passage of the centraliser down a well bore.

Preferably the assembly also includes a centraliser stop collar for longitudinally restraining a casing centraliser when installed on a tubular casing, the stop collar comprising a ring having a substantially cylindrical bore extending longitudinally therethrough, the bore being dimensioned to fit around the casing, and the ring having longitudinal lock means for longitudinally locking the collar to the casing.

The lock means preferably comprises one or more internally threaded bores extending radially through the ring, and a screw-threaded fastener in each internally threaded bore. Each fastener can typically be screwed into contact with the casing to lock the collar in place.

The ring may be formed of any suitable material such as metals like steel, but some embodiments are formed from a zinc alloy which is preferably the same alloy as that from which the centraliser is formed. Each internally threaded bore may be defined by an initially separate thread insert forming an integral part of the collar when fabricated, for example by being cast into the ring, and the thread inserts may be formed of materials which are substantially different from that of the ring, e.g. of brass or steel as compared to a zinc alloy.

Preferably, the centraliser is rotatable on the casing.

The or each centraliser may be longitudinally restrained by a respective stop collar installed upon casing at or adjacent one end of the respective centraliser. One or more centralisers may be longitudinally restrained by a respective pair of stop collars, one of the pair of stop collars being installed on said casing at or adjacent each longitudinally opposite end of the respective centraliser.

The inner surface of the centraliser may have a low friction coating or slider. In some embodiments of the invention the centraliser is coated on its inner and outer surfaces (or on selected parts of these surfaces) with PTFE-impregnated nickel using Niflor™ materials available from Surface Technology plc, preferably using the electroless process known in the art for coating articles with such materials. By slider we mean any member that can present a surface against which the wellbore can bear when the centraliser is in use. The slider can be a button, block or other 3-dimensional object embedded in or adhered to the body or blade, or can be a strip or coating that has negligible or even variable depth. The provision of sliders on the body or blade can be especially beneficial as the sliders can be concentrated on the outermost areas of the body or blade which will have the most contact with the wellbore inner surface, and can therefore be renewed or replaced easily. Indeed, since some areas of the centraliser outer surface can encounter more abrasive conditions than others (e.g. the shoulders of the blades) these can be provided with sliders that are specifically shaped to present the low friction surface of the slider over the whole of the area suffering high abrasion, without having to over-engineer the whole of the body or blade. Also, the sliders on e.g. the shoulders can be made thicker than the sliders provided on less abraded areas of the body or blades e.g. in the middle of the blades, so that the low friction surfaces on the high abrasion areas do not wear out before those on less abraded regions of the centraliser. Therefore, all of the low friction surfaces of the centraliser need not be of the same depth, or shape.

BRIEF DESCRIPTION OF THE SEVERAL VIEWS OF THE DRAWINGS

Examples of a centraliser in accordance with the invention will now be described with reference to the accompanying drawings, in which.

DETAILED DESCRIPTION OF THE INVENTION

Figure 1:
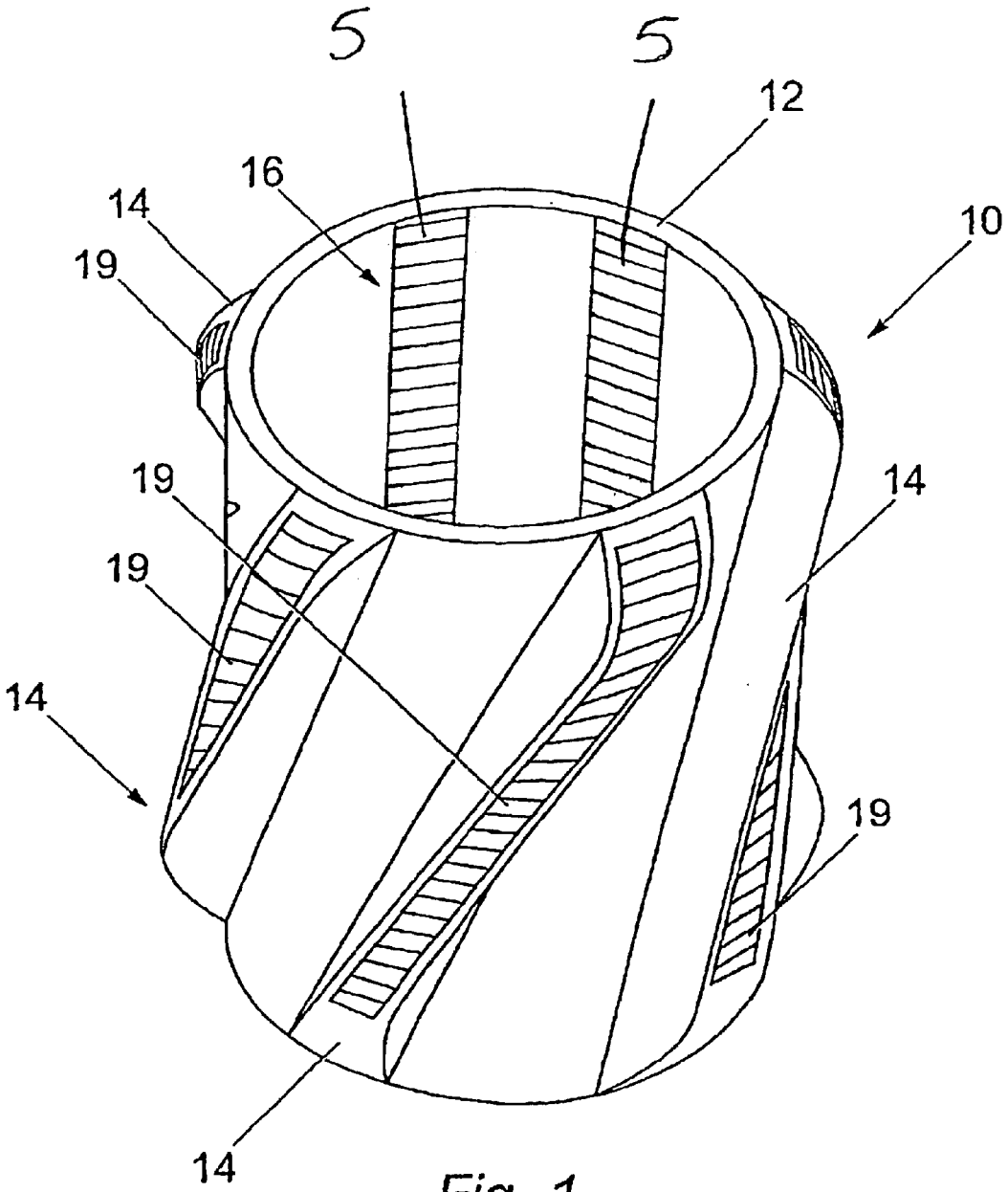
FIG. 1 is a perspective view from above and to one side of a first example of a centraliser.
Figure 2:
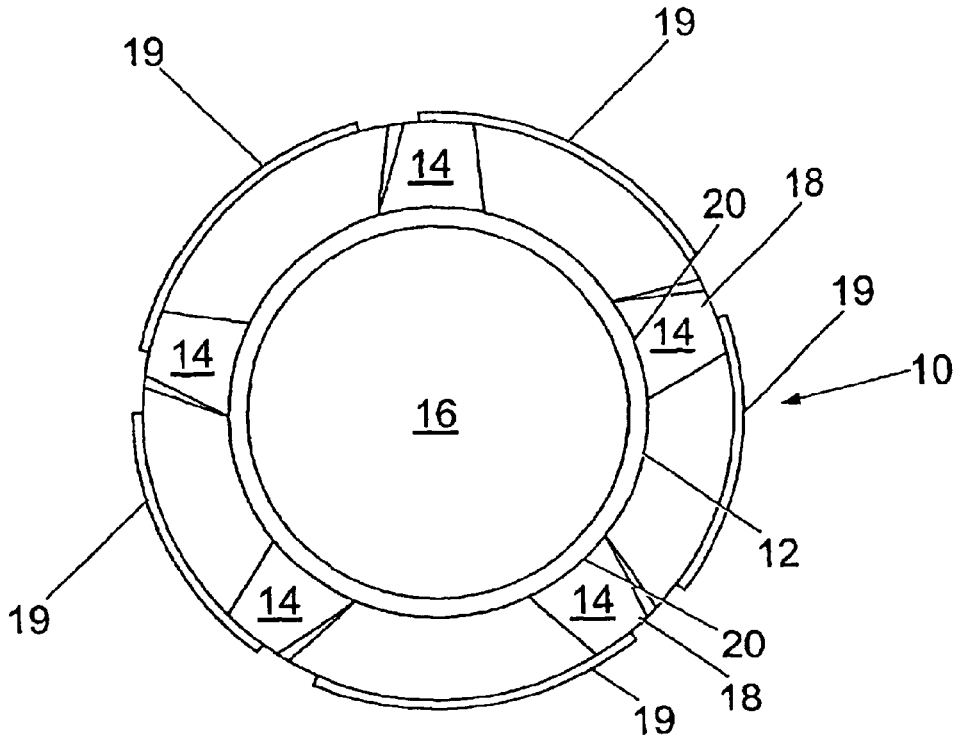
FIG. 2 is a plan view from above of the first example.
Figure 3:
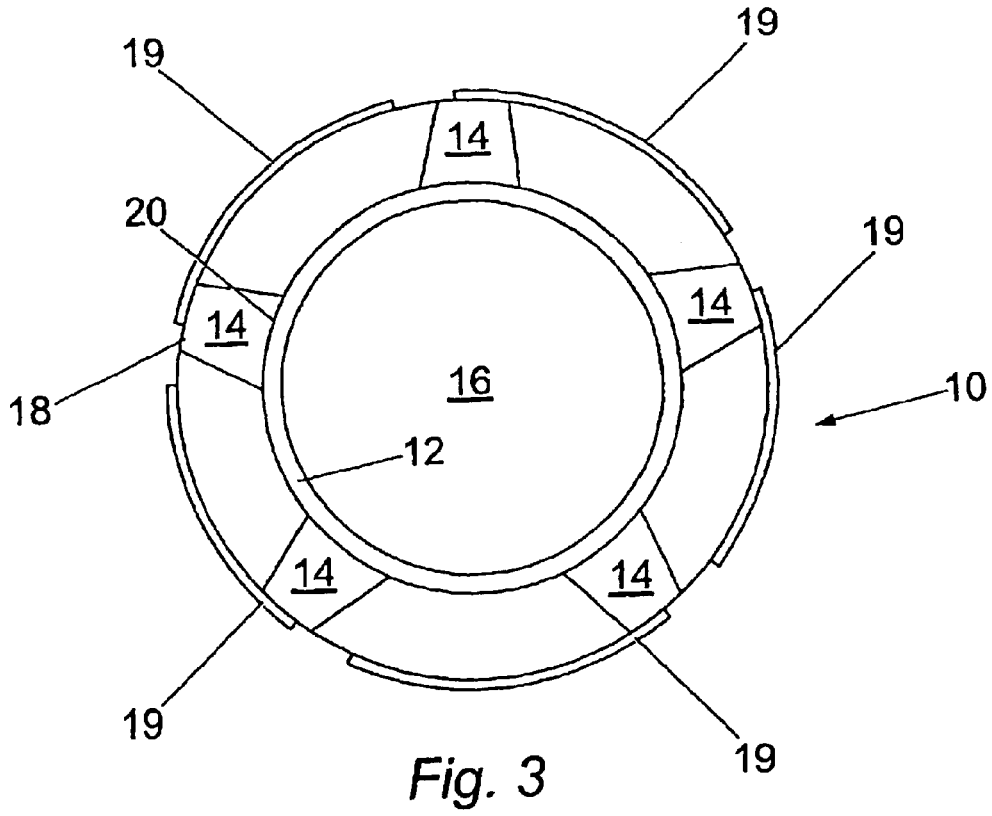
FIG. 3 is an underneath view of the first example.

Referring first to FIGS. 1–3, a casing centraliser 10 has a generally cylindrical body 12, and an array of five blades 14 integrally formed with the body 12 and spaced around it at equal intervals. A cylindrical bore 16 extends longitudinally through the centre of the body 12, the bore 16 having a substantially uniform diameter dimensioned to be a clearance fit around the wellbore casing (not shown in FIGS. 1–8). Each of the blades 14 (see also FIGS. 4 & 5) not only extends between longitudinally opposite ends of the body 12, but also extends circumferentially part-way around the periphery of the centraliser 10. The skewing of the blades 14 ensures that their respective radially outer edges 18 collectively provide a circumferentially substantially uniform well bore-contacting surface for the centraliser 10, as most particularly shown in FIGS. 2 and 3.

Each of the blades 14 has a respective radially inner root 20 integral with the body 12. In each of the blades 14, the root 20 has a greater circumferential width than the outer edge 18, i.e. the cross-section of each blade 14 tapers towards the well bore-contacting periphery of the centraliser 10. The individual and collective shapes of the blades 14, and of the longitudinal fluid flow passages defined between adjacent pairs of the blades 14, gives the centraliser 10 improved flow characteristics and minimises the build-up of trapped solids during use of the centraliser 10.

Longitudinally opposite ends of the blades 14, and of the body 12, are chamfered to assist in movement of the centraliser 10 up/down a well bore.

Figure 4:
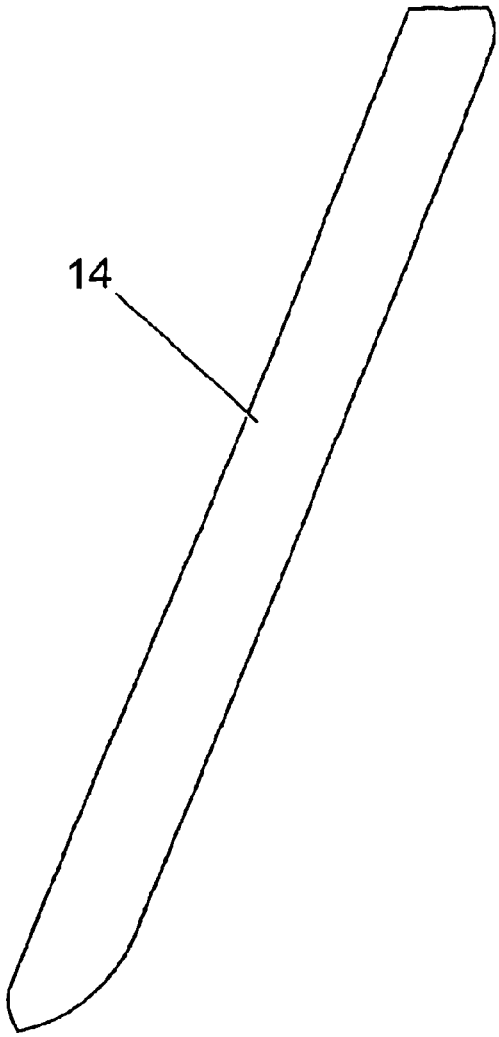
FIGS. 4 and 5 are respectively radial (plan) and circumferential (side) views of a blade forming part of the first example.
Figure 5:
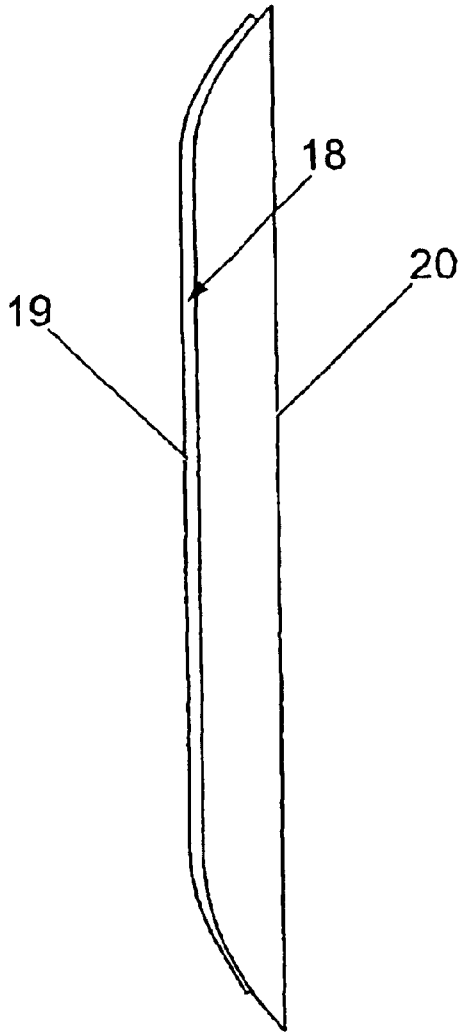

Although the blades 14 are shown separately from the body 12 in FIGS. 4 and 5 (and while the blades 4 could be separately formed and subsequently attached to the body 12 by any suitable means) it is preferred that the centraliser body 12 is fabricated as a one-piece article, preferably by being precision cast in a suitable metal or alloy.

The blades 14 in the first embodiment have strips 19 of polytetrafluoroethylene (PTFE) attached to their outer surfaces 18 to bear against the inner surface of the well bore. The PTFE strips are glued or otherwise attached to the blades. No modification is necessary for the blades to receive the strips 19, but strip attachment plates (not shown) can be provided on the outer surfaces 18 if desired to improve the ability of the strip 19 to attach to the particular metal etc of the body 12. The strips 19 preferably extend from one end of the blades 14 to the other and follow the contours of the blades 14 at the ends where they bend into the body 12. However, this is not necessary and the strips could alternatively be applied in patches along the blades 14. The strips 19 can be applied to each of the blades 14, but a satisfactory embodiment could equally carry the strips 19 (or patches) on one or a few blades 14.

Further PTFE strips 5 are similarly attached to the inner surface of body 12.

The strips 5, 19 are of PTFE, but could alternatively be formed from other low-friction material such as those mentioned above or from polyetheretherketone, carbon reinforced polyetheretherketone, polyphthalamide, polyvinylidene fluoride, polyphenylylene suiphide, polyetherimide, polyethylene, polysuiphone, polyethersulphone, polybutyleneterephthalate, polyetherketoneketone, polyaxnides, phenolic resins or compounds, thermosetting plastics, thermoplastic elastomers, thermoplastic compounds or thermoplastic polyester resins.

Figure 6:
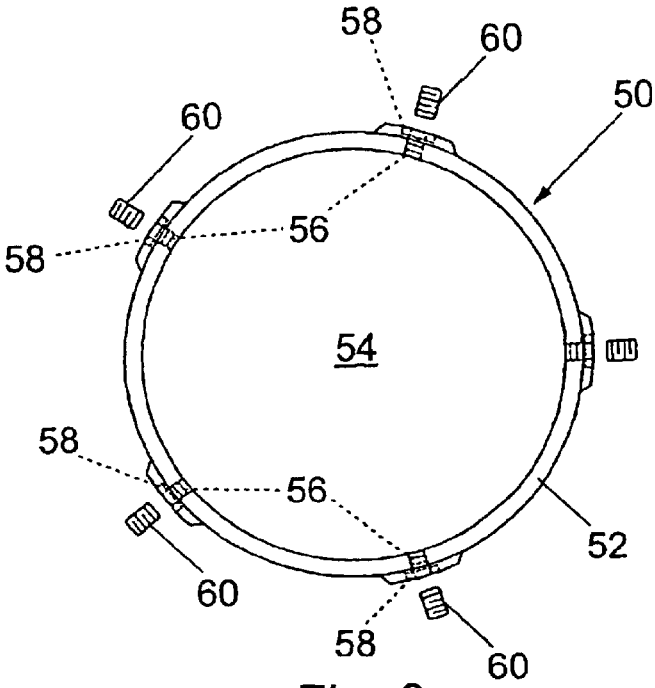
FIGS. 6, 7 and 8 are respectively plan, perspective and side views of a casing stop collar suitable for use in conjunction with the centraliser of FIG. 1.
Figure 7:
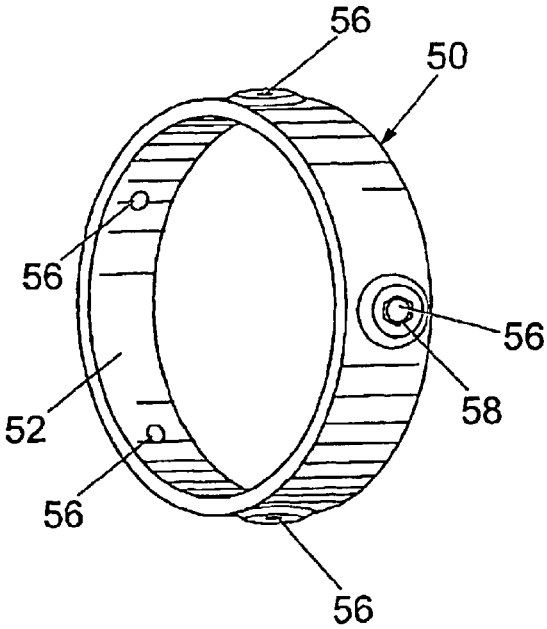
Figure 8:
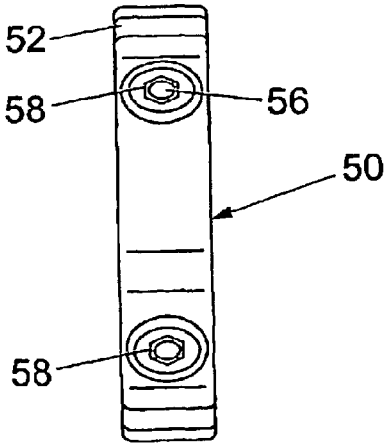

Since the bore 16 is a clearance fit around the casing and since the bore 16 lacks any means of tightly gripping a normally dimensioned casing, the centraliser 10 can not only rotate freely around the casing but also move freely along the casing (unless and until the centraliser collides with an obstruction, for example a protruding casing joint). A stop collar 50 as illustrated in FIGS. 6, 7 and 8 can optionally be used to restrain the centraliser 10 substantially at its preferred location along the casing without impairing relative rotation of centraliser and casing.

The stop collar 50 comprises an undivided ring 52 having a bore 54 about equal in diameter to the bore 16 in order to fit alongside the centraliser 10 on the same casing. The ring 52 is radially penetrated by five internally threaded holes 56. The ring 52 is cast of the same zinc alloy as the centraliser 10, and five thread inserts 58 are either cast into the ring 52 to form the threaded holes 56, or subsequently screwed into or pressed into a previously cast ring.

In use, the ring 52 is fitted around the casing to restrain the centraliser in the desired location. A grub screw 60 is then screwed down each of the threaded holes 56 to tighten against the underlying casing (not shown in FIGS. 6–8) so as to lock the collar 50 onto the casing.

The locked-on collar 50 then provides an abutment which stops longitudinal movement of the centraliser in one direction while allowing free relative rotation of the centraliser and the casing. While a single stop collar would normally be located under a centraliser on vertical or near-vertical casing to prevent unrestricted dropping of the centraliser down the casing, circumstances may dictate that a stop collar be located above a centraliser, or that a respective stop collar be used at each end of a centraliser, for example in deviated wells.

Figure 9:
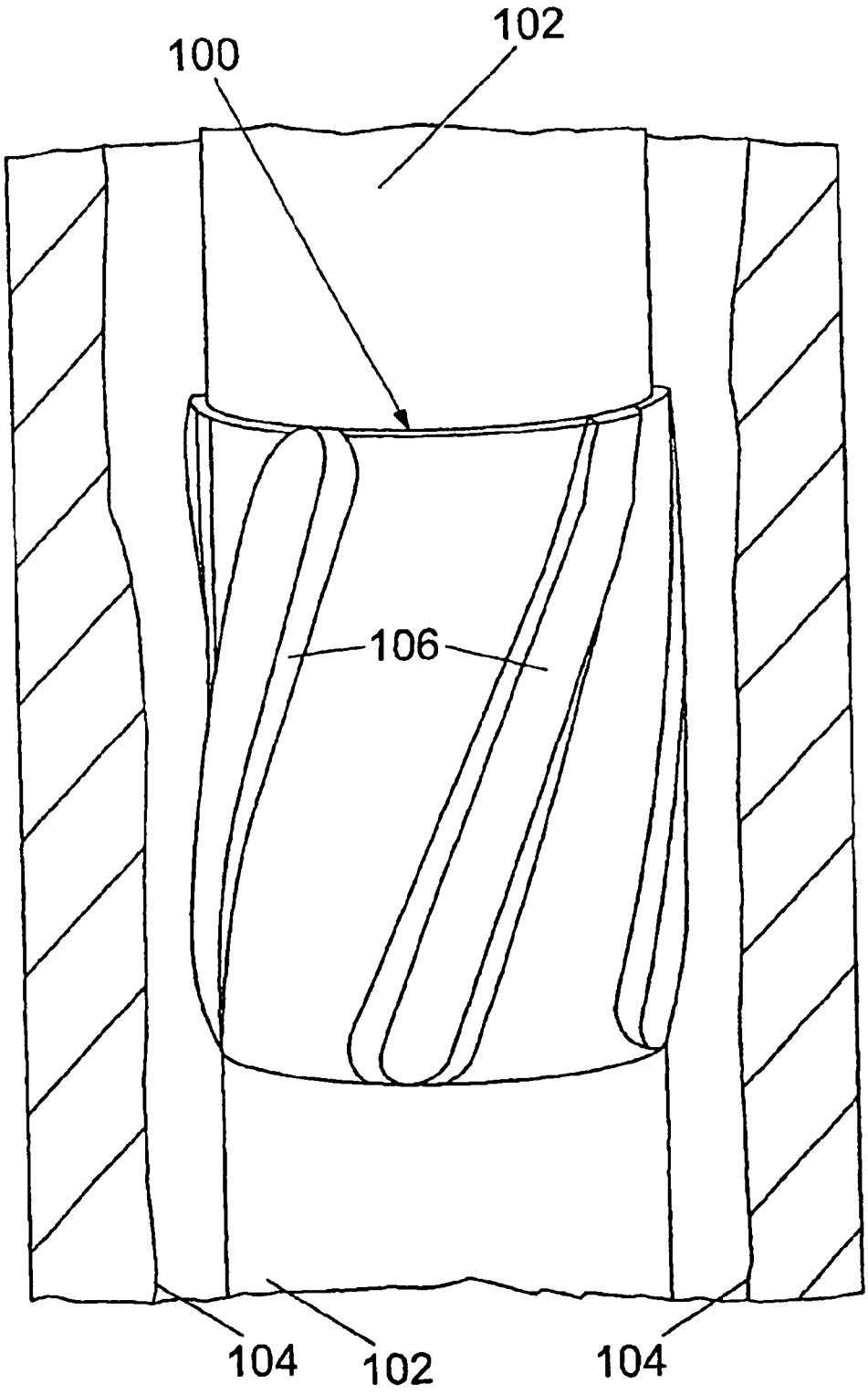
FIG. 9 is a perspective view of a combination of stop collars and a centraliser.

FIG. 9 shows a modified form of casing centraliser 100, fitted around hollow tubular casing 102 which is located within a well bore 104. The modified centraliser 100 is essentially the same as the centraliser 10 described above, and differs principally in the dimensions and proportions of its blades 106, and in that the blades 106 are formed separately of low friction material such as PTFE or another as indicated above, and are later attached to the body of the cast metal centraliser 100.

The blades 106 are circumferentially wider at the lower end of the centraliser 100 than they are at the upper end. FIG. 9 also illustrates the manner in which the centraliser will hold casing out of direct contact with the well bore and centrally within the well bore, in preparation for subsequent cementing.

In a modification to the FIG. 9 embodiment which is identical in appearance, the blades are cast separately from any suitable material such as zinc alloy, and are then coated with a low-friction coating such as the Niflor™ material referred to above, and preferably using the electroless process also referred to above. The treated blades are then attached to the body of the centraliser by any suitable means such as fixings or adhesives etc.

In the case of casing located within larger diameter casing, centralisers can be employed on the inner casing to hold it out of direct contact with the outer casing.

Figure 10:
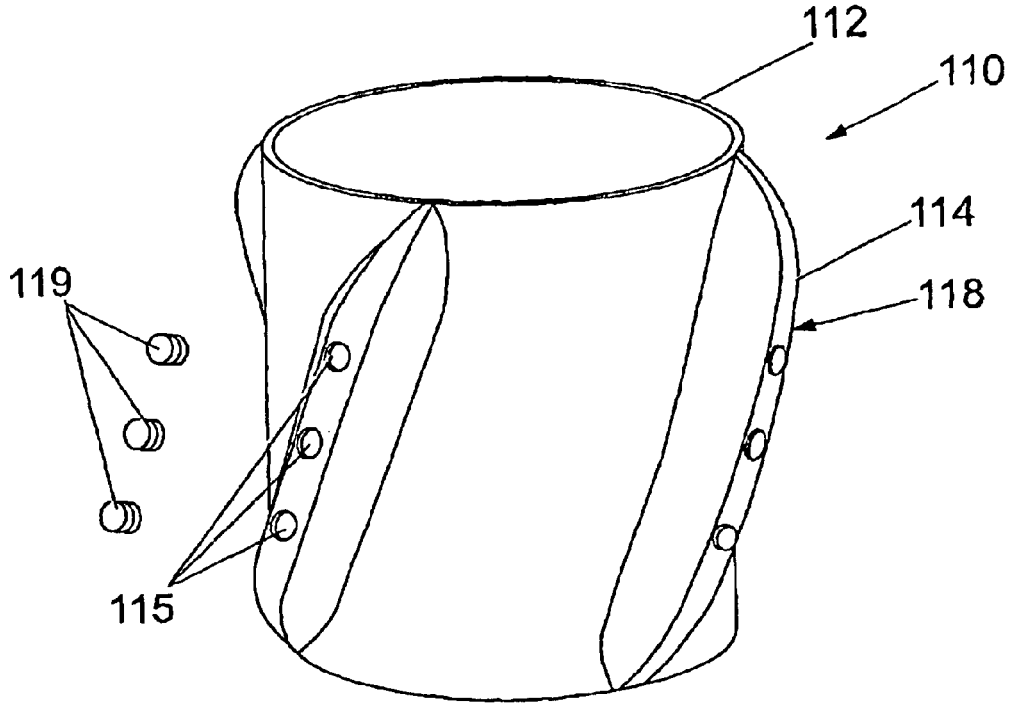
FIG. 10 is a perspective view of a third example of a centraliser.

FIG. 10 shows a further embodiment of a centraliser 110 with a body 112 and blades 114 with radially outward surfaces 118. The centraliser body 112 is typically of cast metal such as Zinc or Aluminium etc, and the blades 114 have apertures 115 to receive cylindrical slider blocks 119 of PTFE or a similar low friction material. The slider blocks 119 engage in the apertures 115 and can be held there by adhesive, fixings or by any other convenient means. The slider blocks 119 protrude by 2–5 mm from the surface of the blades 114 so as to contact the wellbore surface and reduce the friction as the centraliser engages it.

Figure 11:
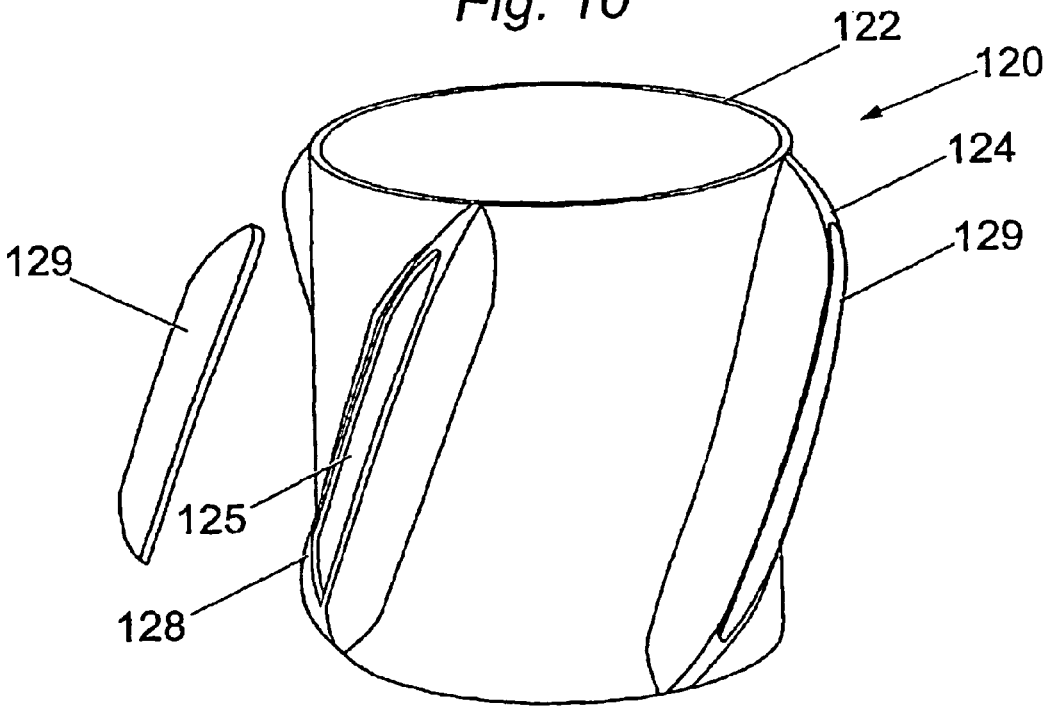
FIG. 11 is a perspective view of a fourth example of a centraliser.

FIG. 11 shows a further embodiment of a centraliser 120 with a body 122, blades 124 having radially outward surfaces 128 and slots 125 along the length of each blade to receive an elongate slider 129 of PTFE or a similar low-friction material as described above. The sliders 129 engage in the slots 128 in the same way as the blocks 119 engage in the apertures 115, and can be held there by adhesive, fixings or simply by their own shape which can be selected to be slightly oversized to retain the slider in the slot or other aperture as required, thereby obviating the requirement for any additional form of fixing. The sliders 129 protrude above the surface 128 of the blades 124 by 2–5 mm to bear against the well bore surface and reduce the friction involved in moving the centraliser against the well bore (or other) surface.

The slider can be selected from various different shapes such as arcuate or polygonal blocks, e.g. squares, triangles, ovals, circles, strips etc.

Modifications and improvements can be incorporated without departing from the scope of the invention.

What is claimed is:

1. A casing centraliser for use in a wellbore having a body with a bore therethrough for receiving a tubular to be centralised, the body having at least one low friction slider on the outer surface thereof, wherein the at least one slider provides a bearing surface with a lower coefficient of friction than the rest of the casing centraliser, wherein the at least one slider comprises any of a button, a patch, a strip, a block, or a blade that is coupled to the outer surface of the centraliser such that the at least one slider contacts the wellbore surface prior to the centraliser contacting the wellbore surface.

2. A casing centraliser as claimed in claim 1, wherein the at least one slider bears against the interior surface of a bore in which the casing centraliser is placed and wherein the at least one slider comprises at least a part of a blade.

3. A casing centralisor as claimed in claim 2, having more than one blade, and wherein the blades are arranged in a peripheral array circumferentially distributed around the body to define a flow path between each circumferentially adjacent pair of blades.

4. A casing centraliser as claimed in claim 2, wherein the radially outer edge of at least one blade has at least one low friction slider in a form selected from the group consisting of coatings, strips and blocks, applied thereto.

5. A casing centraliser as claimed in claim 2, wherein the at least one blade is coated with a low friction material.

6. A casing centraliser as claimed in claim 1, wherein the inner surface of the casing centraliser also has at least one low friction slider in a form selected from the group consisting of blocks, coatings and strips, applied thereto.

7. A casing centreliser as claimed in claim 1, wherein the body of the casing centraliser comprises at least one of the group consisting of Zinc, Aluminum, Steel and a composite material.

8. A casing centraliser as claimed in claim 1, wherein the at least one slider engages in an aperture in the body, so that the slider protrudes slightly from the aperture to extend slightly proud of the outermost surface of the casing centraliser body.

9. A casing centraliser as claimed in claim 1, having more than one slider, wherein at least some of the sliders are of a form selected from the group consisting of buttons, patches and strips that are coupled to the outer surface of the body, so that in use they will contact the interior surface of a bore in which the casing centraliser is placed before the rest of the body of the casing centraliser.

10. A casing centraliser as claimed in claim 1, wherein at least a portion of the at least one slider is formed from compounds selected from the group consisting of: engineering plastics; polymeric ethylene compounds; nylon compounds; Polytetrafluoroethylene (PTFE); polyetheretherketone; carbon reinforced polyetheretherketone; polyphthalamide; polyvinylidene fluoride; polyphenylylene sulphide; polyetherimide; polyethylene; polysulphone; polyethersulphone; polybutyleneterephthalate; polyetherketoneketone; polyamides; phenolic resins or compounds; thermosetting plastics; thermoplastic elastomers; thermoplastic compounds; thermoplastic polyester resins; Polyethlene Terephthalate (PETP); and chemical equivalents and related compounds.

11. A casing centraliser as claimed in claim 1, wherein the at least one slider is not, of even depth.

12. A casing centraliser as claimed in claim 1, having more than one slider and wherein at least one slider differs from the others.

13. A casing centraliser as claimed in claim 1, wherein the body has a low friction coating and the inner and outer surfaces of the body are at least partially coated with one of the group consisting of PTFE-impregnated nickel and phosphorous.

14. A casing centraliser as claimed in claim 1, wherein the body has a low friction coating of uneven depth.

15. A casing centraliser as claimed in claim 1, having at least one blade, and wherein the at least one slider engages in an aperture in the at least one blade, so that the slider provides slightly from the aperture to extend slightly proud of the outermost surface of the blade.

16. A casing centraliser as claimed in claim 1, having at least one blade and having more than one slider, wherein at least some of the sliders are of a form selected from the group consisting of buttons, patches and strips that are coupled to the outer surface of the at least one blade, so that in use they will contact the interior surface of a bore in which the casing centraliser is placed before the rest of the casing centraliser.

17. A casing centraliser for use in a wellbore having opposing surfaces, the centraliser having a body with a bore therethrough for receiving a tubular to be centralised; the body having at least one blade; the blade having at least one low friction slider provided its outer surface; and wherein the at least one slider provides a bearing surface with a lower coefficient of friction than the rest of the centraliser; wherein the blade is coupled to the outer surface of the centralizer such that the slider contacts the wellbore surface prior to the centraliser contacting the wellbore surface.

* * * * *

UNITED STATES PATENT AND TRADEMARK OFFICE

CERTIFICATE OF CORRECTION

PATENT NO. : 6,830,102 B2
DATED : December 14, 2004
INVENTOR(S) : Ian Alastair Kirk et al.

It is certified that error appears in the above-identified patent and that said Letters Patent is hereby corrected as shown below:

Column 6,
Line 34, before “such”, change “centraliser” to read -- body --.
Line 35, after “surface”, change “prior to the centraliser” to read -- prior to the rest of the centralizer --.
Line 41, after “casing”, change “centralisor” to read -- centraliser --.
Line 56, after “casing”, change “centreliser” to read -- centraliser --.

Column 7,
Line 20, after “not” delete the comma.

Column 8,
Line 21, change “provided its outer surface” to read -- provided on its outer surface --.
Line 24, after “of the”, change “centralizer” to read -- body --.
Line 26, change “centraliser contacting the wellbore surface” to read -- rest of the centraliser contacting the wellbore surface --.

Signed and Sealed this

Nineteenth Day of April, 2005

JON W. DUDAS
*Director of the United States Patent and Trademark Office*